United States Patent [19]

Watanabe

[11] Patent Number: 4,474,125

[45] Date of Patent: Oct. 2, 1984

[54] TAG ATTACHING MACHINE

[75] Inventor: Michitoshi Watanabe, Nagoya, Japan

[73] Assignee: Tomoe Special Machine Co., Ltd., Nagoya, Japan

[21] Appl. No.: 413,429

[22] Filed: Aug. 31, 1982

Related U.S. Application Data

[62] Division of Ser. No. 206,613, Nov. 13, 1980, Pat. No. 4,391,210.

[51] Int. Cl.[3] ..... D05B 3/20

[52] U.S. Cl. ..... 112/265.1; 112/104; 112/239

[58] Field of Search ..... 112/265.1, 262.1, 104, 112/2, 121.12, 121.15, 239

[56] References Cited

U.S. PATENT DOCUMENTS

| | | | |
|---|---|---|---|
| 2,421,348 | 5/1947 | Meyer | 112/265.1 X |
| 2,503,809 | 4/1950 | Eastman | 112/265.1 X |
| 2,537,342 | 1/1951 | Golden | 112/104 |
| 2,911,928 | 11/1959 | Burke | 112/104 |
| 3,434,441 | 3/1969 | Given | 112/104 |
| 3,812,800 | 5/1974 | Ziegler et al. | 112/104 |

*Primary Examiner*—H. Hampton Hunter

*Attorney, Agent, or Firm*—Wender, Murase & White

[57] ABSTRACT

Apparatus and method for attaching tags to garments, gloves, handbags and the like includes an assembly for feeding tags from a stacked supply to a tag attaching station, an assembly for affixing the tag to the garment at the tag attaching station, and a control network for controlling and sequencing the tag feed and tag affixing operations. The tag feeding assembly includes a mechanism for gauging the width and thickness of a tag and for adjustably accommodating the same. The assembly also includes a pair of upright arms designed so that a tag having a prepunched hole can be placed with the hole over one of the arms. The other arm may be adjusted relative to the first arm and the positioned tag so that it touches the tag edge. The adjustment of the measuring arm automatically adapts the tag feed mechanism to precisely the required distance necessary to transport the tag from the stacked supply to the tag attaching station. The sequencing and control circuit includes a solid state microprocessor having a manual mode for feeding and attaching one tag at a time and an automatic mode for continuously cycling the assembly during operation.

1 Claim, 12 Drawing Figures

+V
ICL
R
RY1
RY2
TRIAC
3-TERMINAL REGULATOR
1 2 3
48
29
120
44
46
42
100
118
26
82
136
140
142
200
204
206
207
208
210
212
214
216
218
220
222
224
226
228
230
232
234
236
238
240
242
244

TAG ATTACHING MACHINE

This is a division of application Ser. No. 206,613, filed Nov. 13, 1980 now U.S. Pat. No. 4,391,210 dated July 5, 1983.

BACKGROUND OF THE INVENTION

1. Field of the Invention

The present invention relates generally to tag attaching machines, and more particularly, to an apparatus and method for attaching tags of any size and thickness to a garment or other article by means of inexpensive thread.

2. Description of the Prior Art

In the mass merchandising of articles such as garments, handbags, wallets, gloves, hats and the like, it is necessary to place a price tag on each and every article prior to sale to the consumer. In view of the diversity of the types of articles and their shapes and materials, the tag attaching process is not generally amenable to automation. Furthermore, the size, shape and configuration of the tags used for different articles will vary depending upon the requirements or desires of the retailer and the nature of the article itself.

It can be appreciated from the above that the tag attaching operation for all retailers, both large and small, is an expensive, labor intensive operation presenting many serious obstacles.

In an effort to overcome some of the disadvantages noted above, attempts have been made in the past to develop automated or semi-automated equipment for attaching tags of different sizes to garments of different types. The prior art approaches which have thus far received most attention can be divided into two basic types. The first type in essence consists of apparatus for stapling tags directly onto garments using small metal staples. The second type takes the form of a gun-like device which is designed to shoot small nylon connectors into the article whereupon the tag is held in place by short, perpendicular lengths of nylon at each end of the fastener in much the same fashion as the barbs on a fishhook.

While the above types of machines appear to provide a cost-effective way of semi-automating the tag attaching process, it is quite clear that the overall operation nonetheless remains highly labor intensive. Moreover, the fasteners used by these prior art devices, be they staples or nylon links, often cause considerable damage to the article both during the attaching process and, subsequently, when the consumer attempts to remove the tag after purchase. This latter problem is particularly troublesome with respect to clothing apparel made of synthetics or other fine or delicate fabrics.

Of the above two categories of prior art devices, the gun-type device has achieved greatest popularity and for quite some time has been regarded as the best solution to the troublesome tag attaching problem. However, it is now being recognized by retailers in general that the nylon fastener elements, being petroleum based products, are rapidly becoming a high cost factor suggesting that the full solution has not yet been achieved. The high cost of the nylon fastener elements and the increasing use of fabrics and materials which are easily damaged when such fasteners are shot into them from a gun has rekindled interest in the design and development of an improved generation of tag attaching devices.

SUMMARY OF THE INVENTION

It is, therefore, an object of the present invention to attach tags of any size to garments or other articles quickly, inexpensively and without damaging the garment or article.

The present invention has another object in the construction of a tag attaching machine which may be operated rapidly and automatically to feed and affix tags to garments or other articles using inexpensive thread.

A further object of this invention is to construct a tag feed mechanism for a tag attaching machine in which gauges for tag width and thickness are coupled to internal operating mechanisms so that the positioning of the gauge against the tag automatically conditions the apparatus to precisely feed the tags, one at a time, from a stacked array to a tag attaching station.

Another object of this invention is to feed and attach tags to garments or other articles manually or by automatic cycling, with both tag feed mechanisms and tag attaching mechanisms controlled by a single, solid state microprocessor.

The present invention has yet a further object in the construction of a microprocessor controlled tag attaching mechanism including adjustments for automatic cycle time periods, single tag feeding time periods, and tag attaching loop diameters.

The present invention is summarized as a tag attaching machine including a mechanism for feeding single tags from a stacked array to a tag attaching station, a tag affixing mechanism for attaching the tag to a garment or article at the tag attaching station, and microprocessor controls for controlling and sequencing the apparatus. The present invention further contemplates the provision of tag feed adjustment mechanisms which automatically adjust the length of movement of tags from the position of a stacked array to a tag attaching station in response to the adjustment of tag gauge members whereupon the measurement of a particular tag dimension automatically conditions the apparatus for proper feed alignment of tags to the attachment station.

The present invention exhibits numerous advantages over the prior art in that tags of any desired dimension and thickness may be automatically fed from a stacked array, that adjustment of the apparatus to accommodate tags of varying sizes and shapes may be accomplished automatically by merely placing the tag between adjustable measuring gauges, that apparatus control and sequencing is accomplished by a solid state microprocessor, that tags may be quickly and efficiently attached to garments or other articles with an adjustable period between cycles, and that tags may be attached by inexpensive thread from a supply spool without using expensive or potentially damaging metal or plastic fasteners.

Other objects and advantages of the present invention will become apparent from the following description of the preferred embodiment when taken in conjunction with the accompanying drawings.

DESCRIPTION OF THE PREFERRED EMBODIMENT

Figure 1:
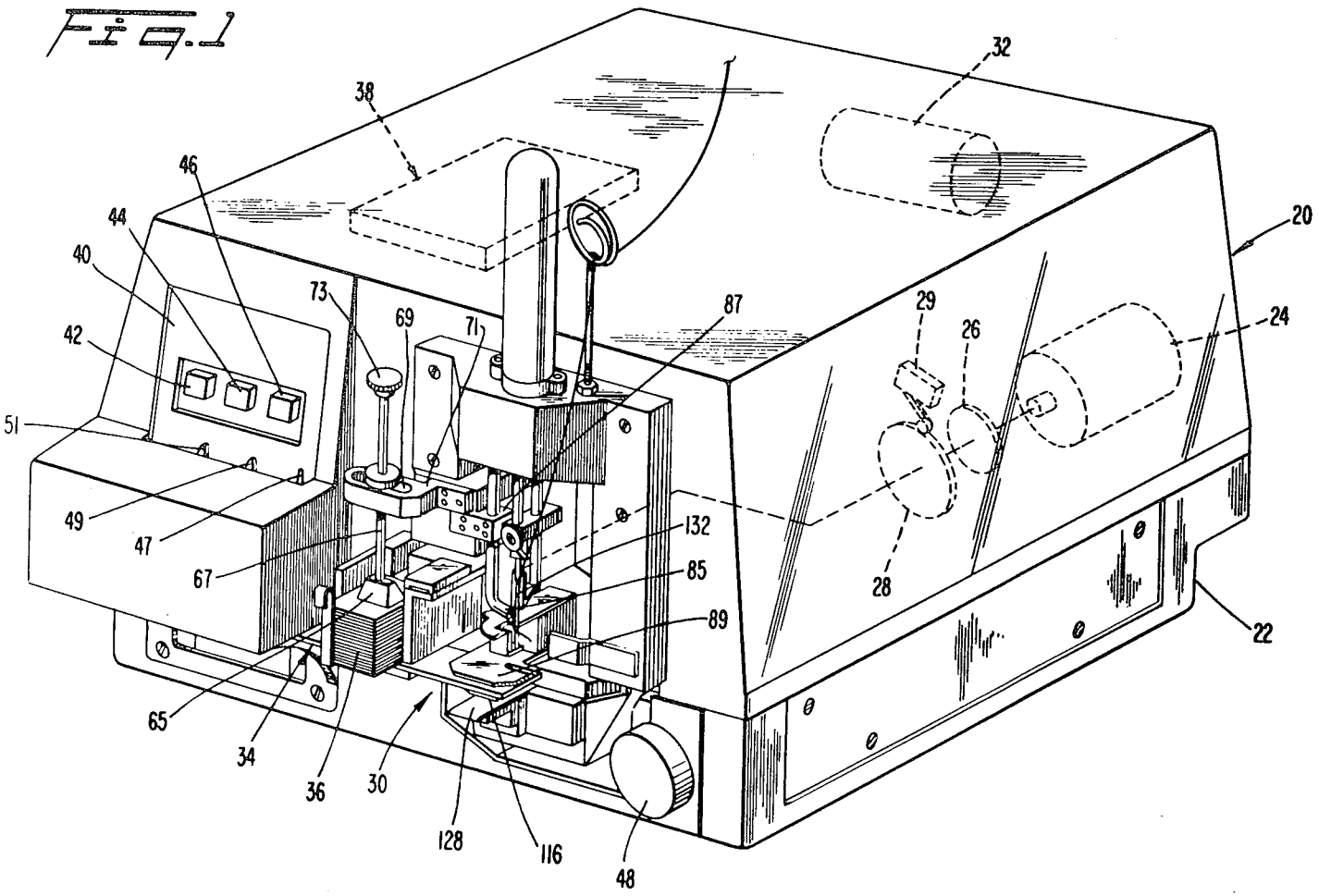
FIG. 1 is a perspective view of a preferred embodiment of a tag attaching machine in accordance with the present invention.

The present invention is embodied in a tag attaching machine shown in perspective view in FIG. 1 and identified generally by the number 20. The tag attaching machine 20 includes a main frame member or base 22 on which is mounted a motor 24 which is coupled through a solenoid actuated clutch mechanism 26 to a main drive gear 28 which in turn is coupled to the tag attaching mechanism at a tag attaching station identified generally with the numeral 30.

The main frame member 22 also supports a pneumatic compressor 32 which provides a source of air, under slight pressure, for actuating various pneumatically controlled mechanisms as will be discussed in more detail hereinbelow. The tag attaching machine 20 also includes a transport mechanism, indicated generally at 34 for moving individual tags from a tag supply 36 to the tag attaching station 30.

The tag transport mechanism 34, the clutch and gear assembly 26, 28, and the mechanism at the tag attaching station 30 are all sequenced and controlled by a solid state microprocessor circuit indicated generally at 38.

Figure 2:
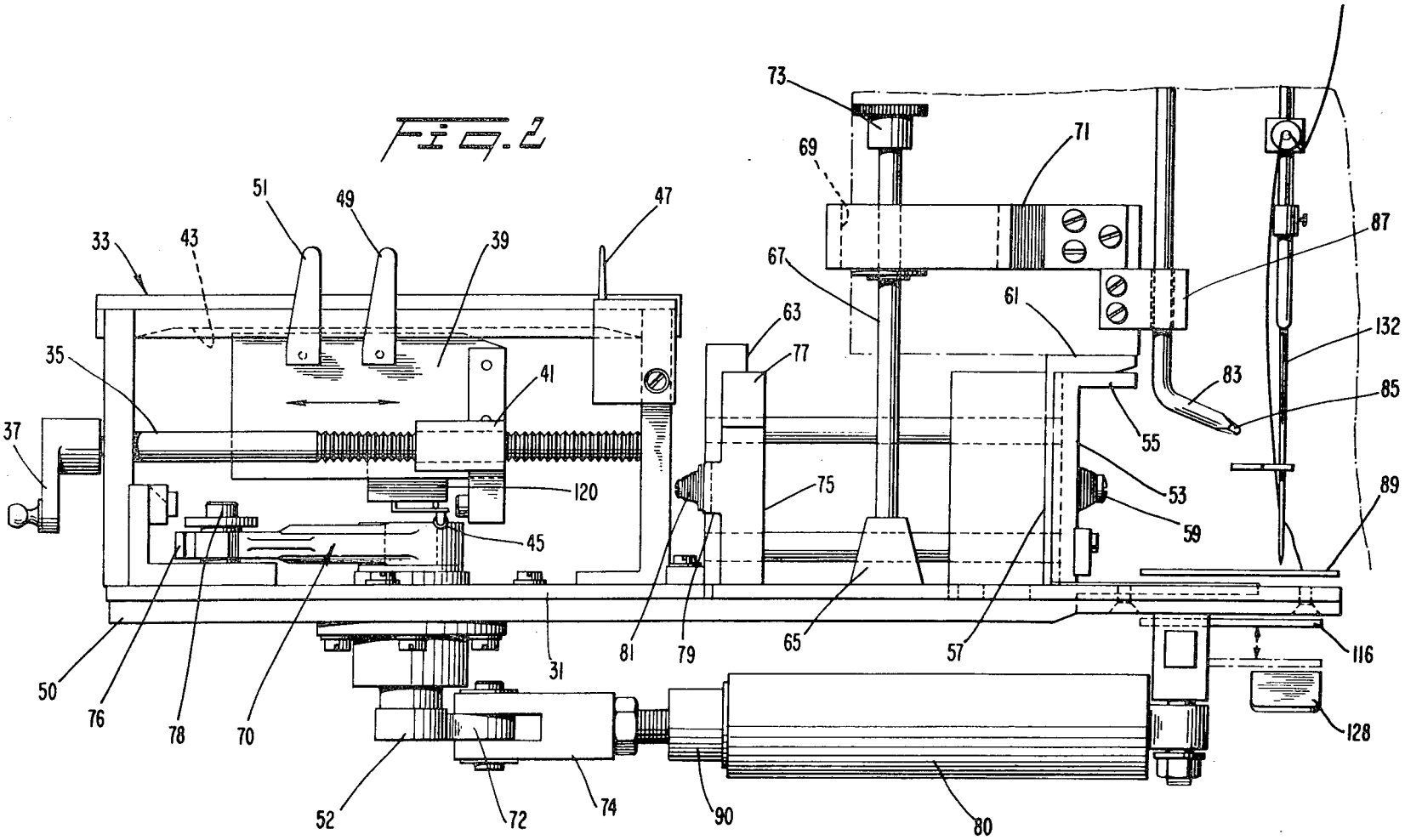
FIG. 2 is a partial front elevational view, with parts broken away, of the tag feed and adjustment mechanism of the machine in FIG. 1 in accordance with the present invention.
Figure 3:
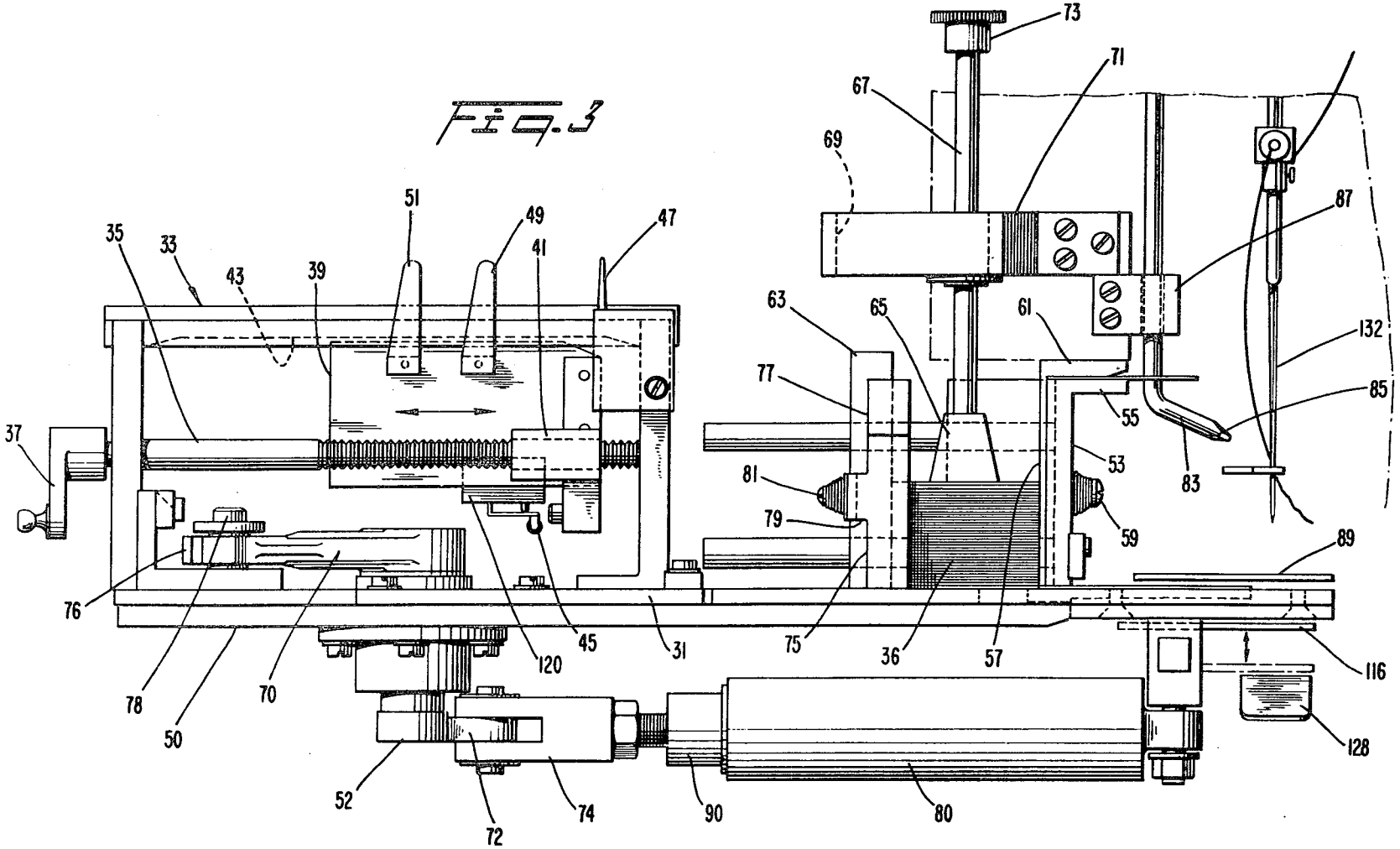
FIG. 3 is a partial elevational view similar to FIG. 2 but showing the tag feed adjustment mechanism in a different position.
Figure 4:
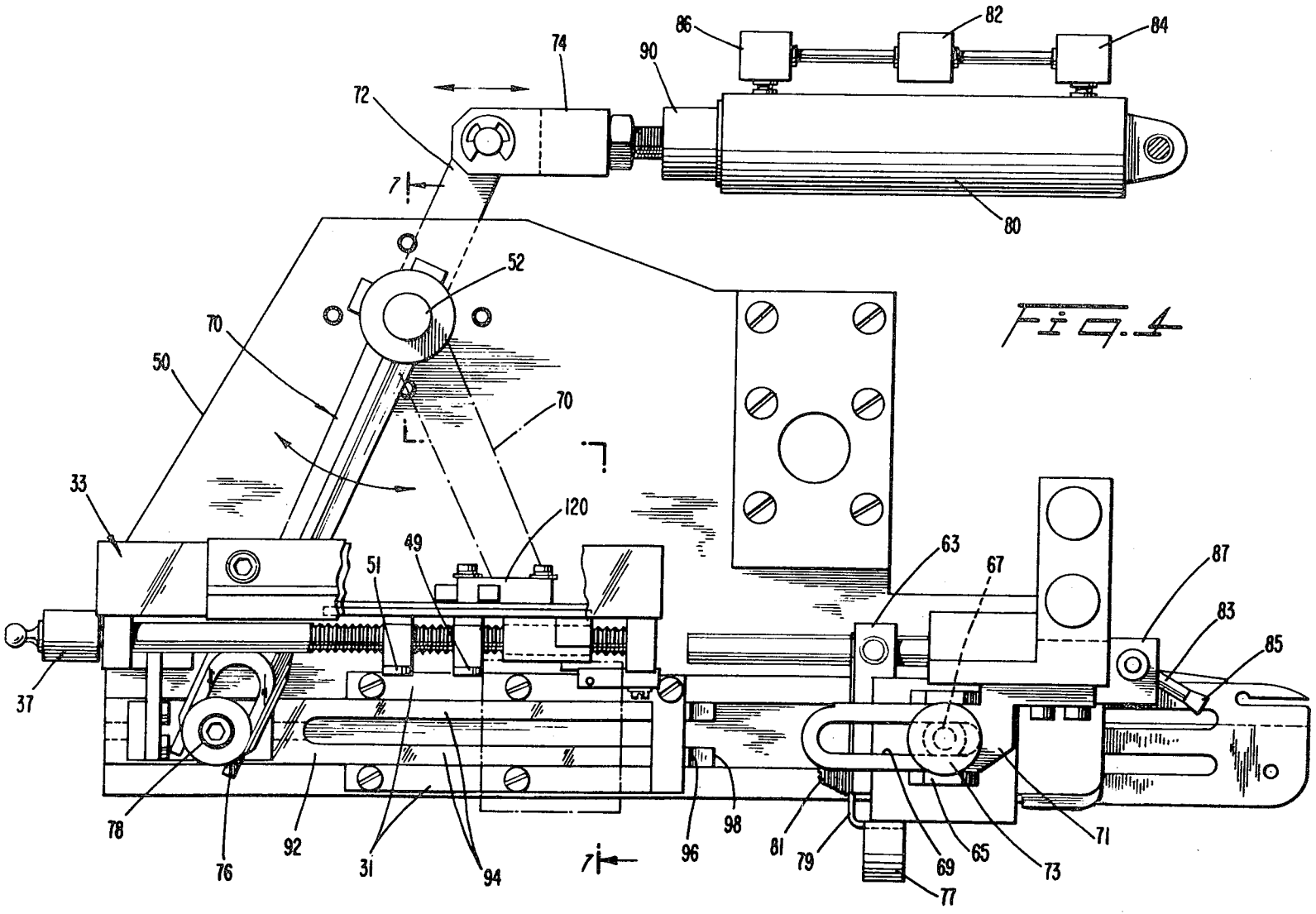
FIG. 4 is a partial top plan view of the tag feed mechanism of FIGS. 2 and 3.

For control of the tag attaching machine, several externally accessible switches are provided. Disposed on a convenient control panel 40 above the transport assembly 34 is an on/off switch 42 controlling the supply of power to the overall machine. Next to the on/off switch 42 is a pushbutton switch 44 which, as will be further described hereinbelow, causes the feed of a single tag from the tag supply 36 to the tag attaching station 30 without initiating a tag attaching operation at the tag attaching station. A further two-position switch 46 is disposed next to pushbutton switch 44 and controls the programming of microprocessor 38 between a manual mode and an automatic mode. In the manual mode, the tag attaching machine 20 may be caused to feed a single tag and attach the same to a garment or article upon depression of a main operator control switch 48. The actuation of switch 48 by the operator causes only a single operation to be performed when switch 46 is in the manual position. When the switch 46 is moved to its automatic position, the machine will repetitively and periodically continue to sequence through successive tag attaching operations thereby permitting the operator to automatically attach tags to garments or articles without having to separately actuate command switch 48 for each sequence. Referring to FIGS. 2, 3 and 4, the tag feed mechanism 34 includes a main mounting member 50 attached to the main frame 22. Journaled for rotation about an upstanding pin 52 on member 50 is a transport actuating lever 70. As can be appreciated from FIG. 4, transport lever 70 is journaled at an intermediate point for rotation in both clockwise and counter clockwise directions about the axis of pin 52. A first end 72 of arm 70 is pivotally attached to a piston 90 by an intermediate connecting element 74. Piston 90 is disposed within a conforming cylinder 80 which is connected by pneumatic lines to a solenoid operated pneumatic valve 82 via an extending outlet 84 and a retracting outlet 86 connected respectively at opposite ends of the cylinder 80 as shown. As will become clear below, the solenoid operated valve 82, when at rest, supplies compressed air from compressor 32 through retracting outlet 86 to the end of cylinder 80 so as to cause the piston 90 to retract to the position shown in FIGS. 2 and 4.

The opposite end 76 of lever arm 70 is bifurcated to receive an upright post 78 carried upon a tuning fork-like tag push member 92. The tag pusher member 92 has two tines 94 each provided at their distal ends with an offset shoulder 96 having a slightly downwardly inclinded bottom surface 98.

Figure 7:
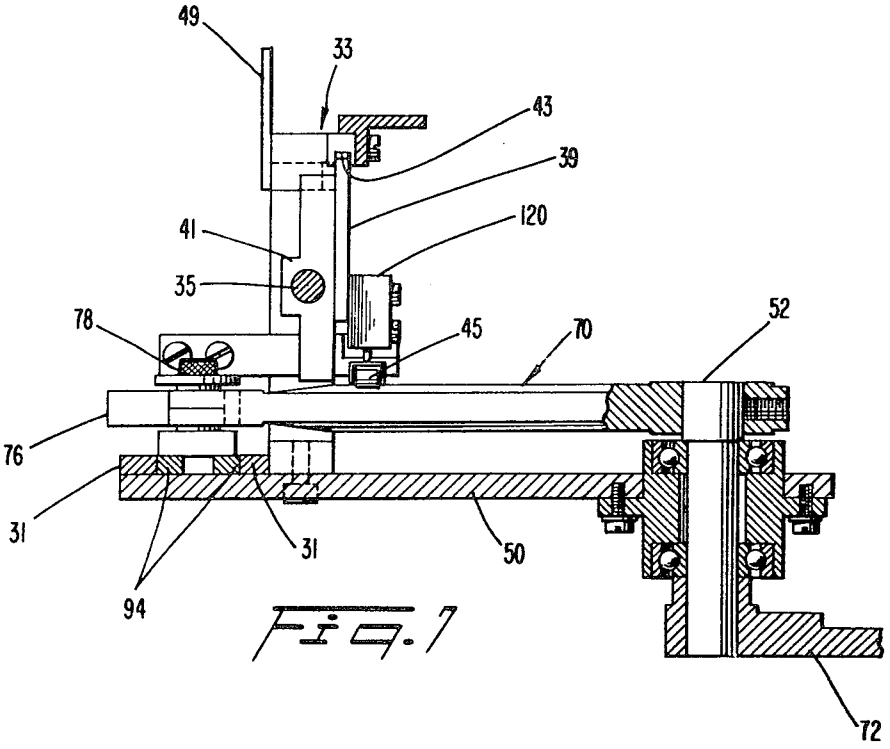
FIG. 7 is a sectional view taken along line 7—7 of FIG. 4.
Figure 5:
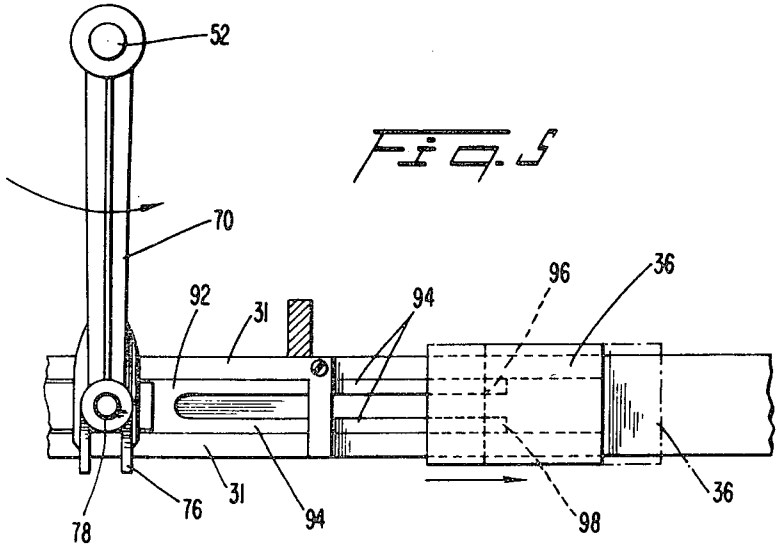
FIG. 5 is a partial plan view of the mechanism of FIG. 4 showing the tag feed assembly in an intermediate position.
Figure 6:
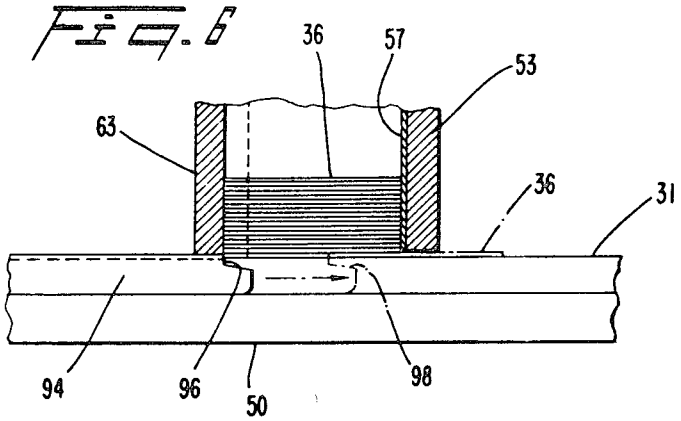
FIG. 6 is a detailed front elevational view of the tag pick-up member of the feed mechanism of FIGS. 1 and 2.

Pusher member 92 is disposed atop plate 52 between a pair of spaced, elongated channel guides 31. The top surface of the channel guide members 31 is coplaner with the top surface of the tines 94 of pusher member 92 as can best be seen in the sectional view of FIG. 7. These members thus form a generally flat transport plate or surface so as to enable tags to be fed from the tag supply stack 36 to the tag attaching station 30 whenever the pusher member 92 is rectilinearly shifted from the left to the right as visualized in FIG. 4 under the driving force of the counter clockwise rotating lever arm 70.

Turning to FIGS. 2 and 3, a generally U-shaped frame member 33 is secured to the top of support plate 50. Rotatably disposed across frame 33 is a threaded rod 35 having a crank handle 37 attached at one end. An adjustable support block 39 is attached to a threaded nut 41 carried on the opposite end of rod 35, as illustrated. The upper edge of block 39 is adapted to be received within a shallow groove or channel 43 in the lower surface of the cross portion of frame 33 so as to preclude the block 39 from rotation as crank handle 37 is turned. In this manner, turning of the crank handle causes linear transposition of the block 39 as can be appreciated from a comparison of FIGS. 2 and 3.

Carried upon block 39 is a microswitch 120 having an actuating roller 45. The microswitch 120 is mounted on block 39 such that the roller 45 is in the path of rotary movement of lever arm 70. As will be described in more detail herein below, the microswitch is actuated each time the lever arm 70 moves in a counter clockwise direction, as visualized in FIG. 4. Thus, as the lever arm rotates from the rest position shown in FIGS. 2 through 4 to a tag feed position as shown in phantom lines in FIG. 4, the microswitch will be actuated.

Mounted on the cross member of frame 33 is an upright pin or arm 47. Similarly, a pair of spaced upright arms 49 and 51 are attached to moveable block 39. Pin 47, which is fixed with respect to frame 33, cooperates with arms 49 and 51 to form a tag width gauge. As can be appreciated from FIGS. 2 and 3, the tag width gauge may be easily used by merely positioning a single tag such that a prepunched hole therein is placed over pin 47. With the tag thus in position, crank 37 is rotated to move arm 49 until it just engages the edge of the tag as shown in FIG. 3. Since the movement of arm 49 on block 39 by turning crank 37 also causes a like movement of microswitch 120, it can be appreciated that the end point of travel of lever 70, which is determined by the microswitch 120, will be adjusted each time as the tag width is measured. By coordinating the tag width gauge measurement with the positioning of the microswitch 120 on block 39 and with the distance between the tag supply stack 37 and the tag attaching station 39, the tag pusher member 92 can be caused to move precisely the amount required to shift a tag from the stacked array to the tag attaching station by merely taking a representation tag and placing it in the width measurement gauge and adjusting crank 37.

Since the tag width may vary over a considerable extent, it may be necessary in certain instances to remove tag push member 92 and replace the same with one having shorter tines 94. When the substitute push member is thus installed, the second gauge arm 51 carried by moveable block 39 may be used in conjunction with fixed arm 47 to measure tag width and set the microswitch 120 accordingly.

It can be appreciated from the above that the tag attaching machine according to the present invention is quickly and precisely adaptable to use with tags of widely varying widths. Moreover, the adjustment is extremely simple and merely requires that the operator place the tag between the appropriate gauge members 47 and 49 or 47 and 51 and then merely rotate the crank 37 to conform to the tag dimension. This action automatically transpositions the microswitch 120 so as to establish the end point of travel of lever arm 70 whereupon the push member 92 will move the tag the precise distance necessary to bring the same into perfect alignment at the tag attaching station 30.

The apparatus according to the present invention further includes a tag thickness gauge. Refering again to FIGS. 2 and 3, the tag supply stack 36 is adapted to be placed against a retaining member 53 which is mounted such that its lower edge is spaced from the upper surface of the support plate formed by guides 31 and tines 94 of push member 92 so as to permit a tag of maximum intended thickness to pass therebetween. At the top of retaining member 53, a perpendicular leg 55 extends toward the tag attaching station such that the retaining member 53 and attached leg 55 have a generally L-shaped section. A shutter 57 is mounted against the retaining member 53 by suitable means such as a screw 59 which extends through a slot in member 53. A perpendicularly disposed leg 61 extends from the top edge of shutter 57 such that the shutter also has a generally L-shaped section. The dimensions of shutter 57 are such that the spacing between leg members 55 and 61 is precisely the same as the opening at the bottom of the shutter above the tag supporting plate formed by tines 94 and support members 31. By placing a selected tag between members 55 and 61, and, after loosening screw 59, adjusting the shutter 57 accordingly, the shutter opening will be quickly and precisely set to permit only one tag to be withdrawn from the tag supply 36 and shifted to the tag attaching station 30.

On the opposite side of the tag supply stack 36 from retaining member 53 is a second retaining member 63. This member may be moved to the left and to the right so as to accommodate tags of different widths and maintain the same in a neat stack. A weight 65 is attached, preferably with some degree of freedom to the bottom end of a rod 67 which is loosely held in an elongated slot 69 in a holding member 71. A handle 73 is attached to the top of rod 67 so that the rod and weight may be picked up and moved and then replaced atop a stack of tags 36 to maintain the same in proper alignment.

The tag supply 36 is also provided with a tag retention member 75 in the form of a generally flat strip of material having its top end bent over to form a finger grip portion 77 and having an ear 79 attached to wall member 63 by any suitable means such as screw 81. Member 75 may be positioned to accommodate tags of varying depths and effectively prevents the tag supply from inadvertent dislodgement.

A metal tube 83 has an opening 85 shaped to form a nozzle. The tube 83 is held in position by an appropriate block 87 and is adapted to be connected to compressor 32 so as to feed a stream of air against the needle 132. The stream of air eminating from nozzle 85 clears the severed loose ends of the thread after each tag attaching sequence and blows the remaining tag end to the right, as visualized in FIGS. 2 and 3, so as to place the thread end in the proper position for pick up during the next tag attaching sequence.

Figure 8:
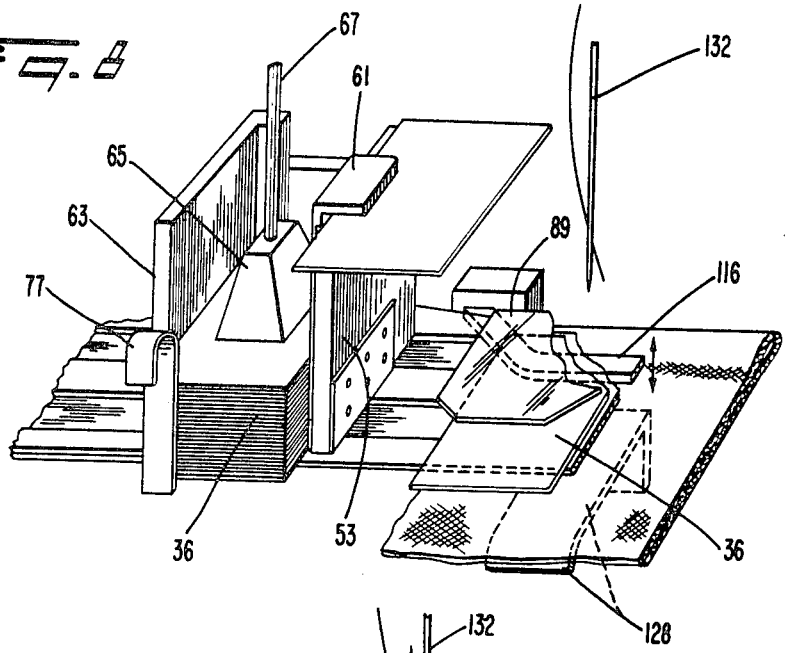
FIGS. 8, 9 and 10 are partial perspective views of the tag attaching station of the machine of FIG. 1 in start, intermediate and finish positions, respectively.
Figure 9:
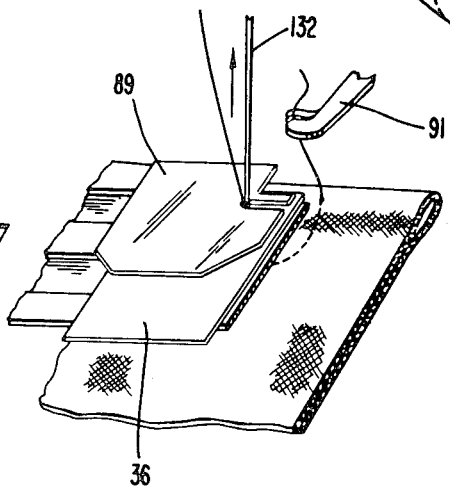
Figure 10:
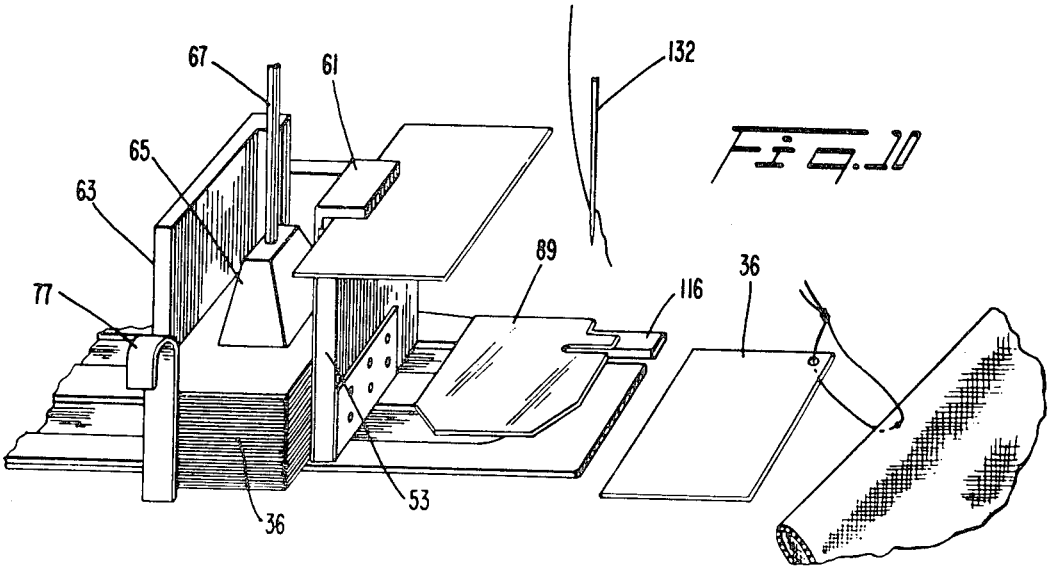

Referring to FIGS. 8, 9 and 10, FIG. 8 shows the positioning of the various elements at or near the tag attaching station 30 just prior to the first tag attaching operation. At this time, a single tag has been moved from the tag supply stack 36 to the tag attaching station 30 and is sitting between the upper surface of the support plate and a guard plate 89. An article to which a tag is to be attached is positioned over the presser block 128, as shown. The operator then commences the tag attaching sequence by engaging switch 48 (FIG. 1). This begins the entire sequence and initially causes the needle 132 to move down. The needle will continue to travel down through the hole in the tag and through article until it reaches the lowest position of travel. At this point, a pick up mechanism 91 is operated to grasp the end of the thread at the lower end of the needle under the article. At this time, the presser foot 116 will have pressed the article against presser block 128 to hold it securely in place. As the needle 132 begins to move back in the upward direction, the pick up mechanism will also move the end of the thread up above the guard plate 89 as shown in FIG. 9. Depending upon the duration of the down position of the presser foot 116, the length of the loop thus formed, as depicted in FIG. 9, will vary. As will be described more fully herein below, the presser foot down duration is controlled by the microprocessor 38, and a timing network included therein may be adjusted to select any desired loop diameter.

At the conclusion of the tag attaching sequence, the article is pulled from the tag attaching station whereupon the knotting mechanism (not shown) completes its function and the next article may be then moved into position.

Figure 11:
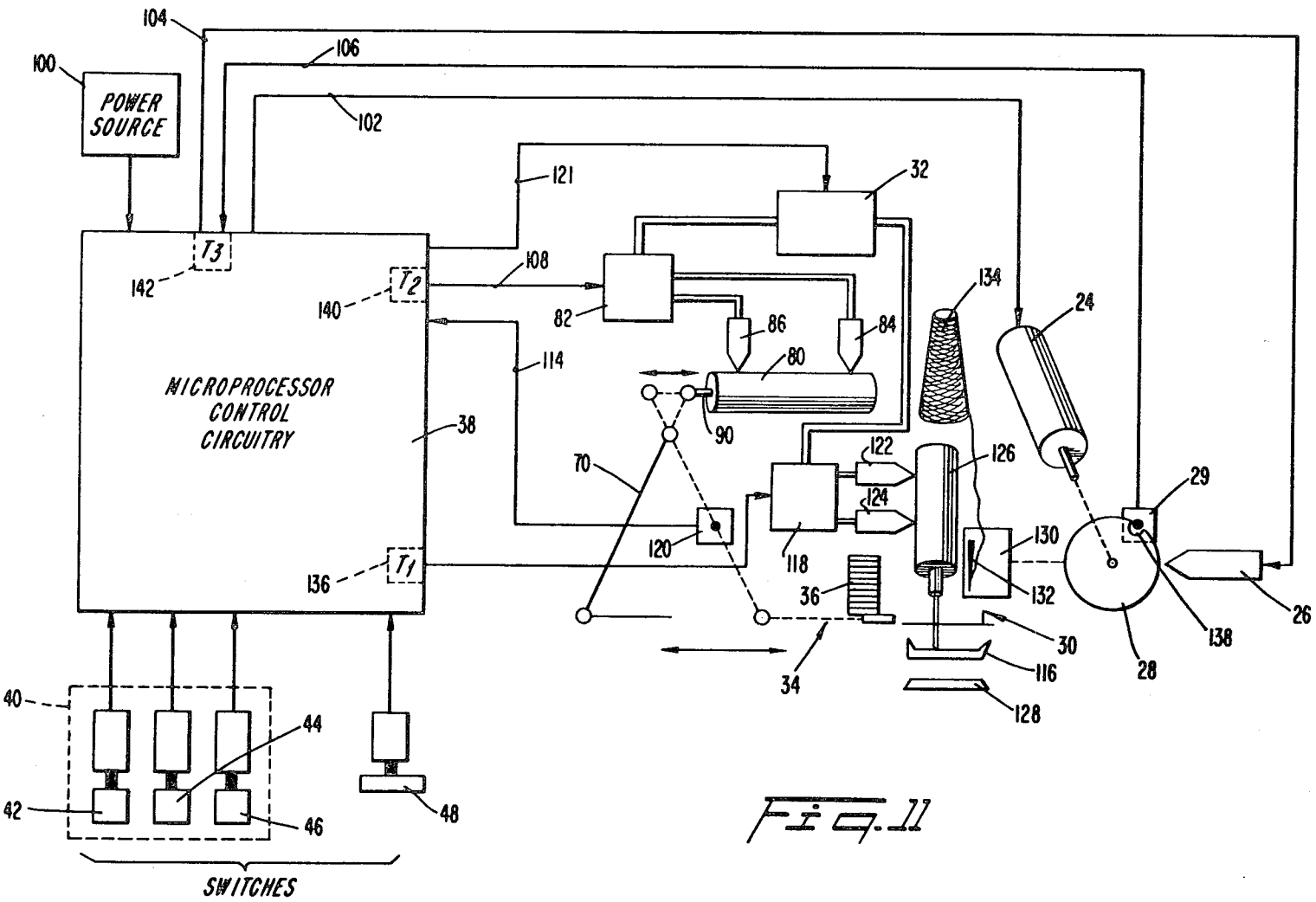
FIG. 11 is a diagrammatic block diagram of the microprocessor controlled functional elements of the tag attaching machine according to the present invention.

Referring now to FIG. 11 the operation of the present invention through the control of microprocessor circuitry 38 will be explained in detail. The microprocessor circuitry 38 is connected to a source of power designated generally as power supply 100. The power derived from supply 100 is utilized by the microprocessor to selectively operate the other elements of the invention.

Control of the microprocessor circuitry 38 is achieved through a plurality of switches connected to its inputs. As discussed above, a control panel 40 includes a two-position switch 42 which turns the microprocessor on and off, a push button switch 44 to cause movement of the transport mechanism without actual attachment of the tag, and a two-position switch 46 to operate the microprocessor in either manual or automatic modes. In the manual mode, a first operation of switch 46 followed by operation of a command switch 48 causes movement and attachment of a single tag, whereas in automatic mode successive operations of the tag attaching mechanism result from a single operation of the command switch 48.

The motor 24 receives power from the microprocessor via line 102. The gear 28 is engaged to be driven by the motor 24 upon operation of a clutch 26 controlled by the microprocessor via line 104. A limit switch 29 detects the position of gear 28 and directs this information to the microprocessor via line 106.

The transport mechanism 34 operated via cylinder 80 is controlled through a solenoid valve 82 connected to the microprocessor via line 108, to the cylinder 80 by outlets 84 and 86 to control respectively extending and retracting piston 90, and to a pneumatic compressor 32. Power to the pneumatic compressor 32 is controlled by the microprocessor via line 112. A microswitch 120 which detects the position of the tag feeder arm 70 transmits this information to the microprocessor on line 114.

The microprocessor also controls a presser foot 116 by means of a solenoid valve 118 connected to line 121, to extending outlet 122 and retracting outlet 124 of air cylinder 126, and to the pneumatic compressor 32. In operation, the presser foot 116 is extended to retain the material against presser block 128 directly below the attaching station 30 during movement of the attaching mechanism 130 including needle 132 and thread 134.

To perform a single tag attaching operation, switch 42 is first moved to its "On" position, thereby causing power to be applied to the motor 24 and the pneumatic compressor 32. Switch 46 is placed in "Manual" position and switch 44 is operated once. In response, microprocessor circuitry 38 institutes movement of the transport mechanism 34 by operating the solenoid valve 82 via line 108 thereby directing air from the pneumatic compressor 32 into extending outlet 84 which causes a tag to be moved from the stack of tags 36 towards the tag attaching station 30. When the selected tag has been completely moved into place in the tag attaching station 30, microswitch 120 is engaged by the tag feeder arm 70 and transmits this information to the microprocessor on line 114. Upon receipt of this signal the microprocessor disables solenoid valve 82 which causes air from the compressor 32 to be directed to retracting outlet 86 so that the piston 90 retracts into the cylinder 80 and the transport mechanism 34 moves back to its initial position.

By operating switch 44 once, the resulting movement of tag mechanism 34 causes a selected tag to be moved to the tag attaching station 30. At this time, the alignment of the tag can be verified and any needed changes in the tag gauges can be made.

If attachment of the selected tag to the garment is desired, operation is continued by placing a garment on presser block 128 and pressing the command switch 48 one time. In response, the microprocessor simultaneously institutes movement of the presser foot 116 and the attaching mechanism 130. A signal on line 120 causes the solenoid valve 118 to direct air from the compressor 32 to the extending outlet 122 of the presser foot cylinder 126, thereby driving the presser foot 116 against the presser block 128 to hold the garment in place. After a predetermined albeit adjustable time, solenoid valve 118 is switched off thereby directing air into retracting outlet 124 so the presser foot 116 lifts off a presser block 128. Meanwhile, the attaching mechanism 130 is activated by controlling the clutch 26 so that cam gear 28 engages the motor 24.

The needle 132 and thread 134 of the attaching mechanism pass through the selected tag and garment in the manner described hereinabove. As the attaching mechanism draws the thread around the presser foot 116 a loop is formed and subsequently tied by further operation of the attaching mechanism. Thus, the length of the resulting loop is dependent upon the distance between the actuating mechanism 130 and the presser foot at the moment the thread is tied.

Therefore, the length of time the presser foot 116 is extended is directly related to the length of the resulting loop: if the presser foot is retracted early, the distance is small when the thread is tied whereas keeping the presser foot down causes a greater distance and hence a longer loop at the moment of tying. The length of time the presser foot is extended is controlled by an adjustable delay circuit 136 located in the microprocessor.

Continued movement of the attaching mechanism 130 via the gear 28 and the motor 24 results in completed attachment of the selected tag by means of needle 122 containing thread 124. At the time when the selected tag has been properly attached, position-indicating means 138 located on gear 28, such as a notch 138, causes operation of the limit switch 29. This information is received by the microprocessor on line 106 which, in response thereto, directs operation of the clutch 26 so as to disengage the gear 28 from the motor 24. There is, however, sufficient momentum left in gear 28 to cause continued movememt of the position-indicating notch 138 of the gear past the limit switch 29 so that the limit switch 29 is no longer engaged.

At this point, the tag attaching procedure has completed one full cycle and the garment with tag can be removed thereby simultaneously cutting the tied thread free.

The signal generated by engagement of the limit switch 29 is used for second function by the microprocessor, however, to prepare for another tag-attaching operation. In addition to disengaging the clutch 26, the microprocessor in response to operation of the limit switch causes the transport mechanism 34 to deposit another tag in the attaching station 30 per the steps set forth herein above. The last step of each attaching cycle, therefore, is to deposit another tag in the attaching station so as to be ready for a second operation of the command switch 48.

An adjustable delay circuitry 140 is included in the microprocessor connected to line 108 leading to the transport mechanism solenoid valve 82 to vary the interval between completion of tag attachment by attaching means 130 and the delivery of another tag in the manner described immediately above. This allows an operator sufficient time to remove the previous garment and tag from the attaching station 30 and presser block 128 so as to avoid jamming the device by delivering a new tag before removal is completed. The interval is adjustable to provide for varying degrees of skill among operators of the machine.

Successive operations of the command switch 48 while switch 46 is in "Manual" setting causes the foregoing sequences to be repeated each time in response thereto. If the switch 46 is moved to "Automatic" position and the command switch 48 is then operated, the foregoing events occur as described above with the additional step that operation of the limit switch 29 by gear 28 also causes the microprocessor to initiate another cycle of the attaching means, presser foot and transport mechanism upon completion of the prior cycle. In this manner, successive attachments of the tags occur automatically in response to a single operation of the command switch 48, until switch 46 is moved back to "Manual" position thereby completing the current cycle and then stopping.

An adjustable delay circuit 142 included in the microprocessor may be used to control the interval of time between successive cycles of tag attaching when operating in the automatic mode.

It may be appreciated that many different devices may be used to implement the circuitry and control mechanisms described hereinabove. For example, the clutch 26 engaging gear 28 may be a magnetic-type clutch, a pneumatic or hydraulic clutch, or a fully electronic braking system. Similarly, the devices used to operate the transport mechanism 34 and the presser foot 116 may comprise pneumatic devices as discussed above or, alternately, bi-directional electric motor, hydraulic devices of any other suitable mechanisms.

Figure 12:
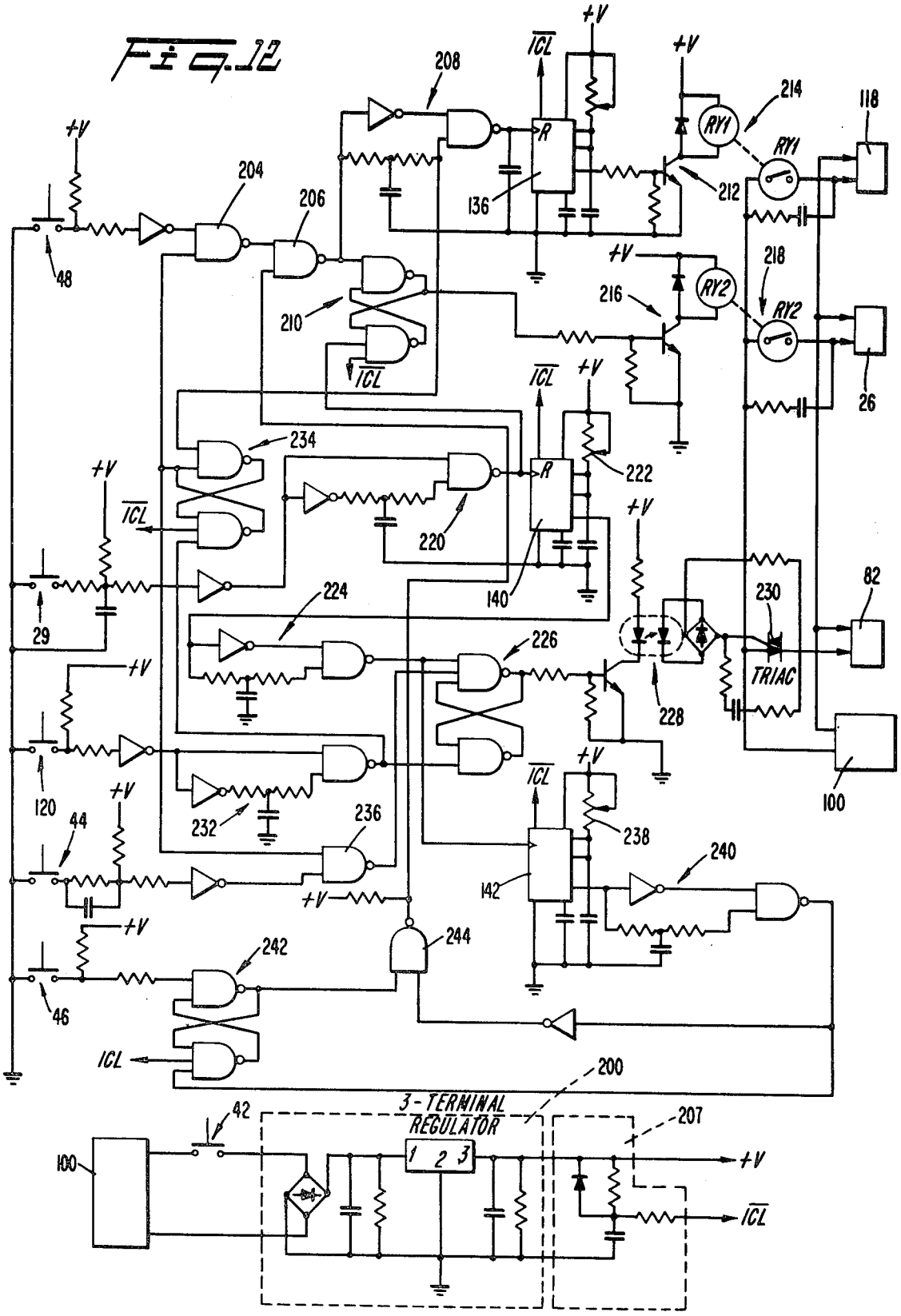
FIG. 12 is a schematic diagram of the microprocessor control circuitry of FIG. 11.

The microprocessor circuitry 38 may be designed in a variety of ways so as to accomplish the particular operating functions discussed hereinabove. A preferred embodiment of the microprocessor is illustrated in FIG. 12, wherein the reference characters correspond to those used in FIG. 11.

The preferred embodiment comprises a known DC power supply 200 connected through the on/off switch 42 to the power source 100 to develop an internal voltage and ground. A reset pulse $\overline{ICL}$ is developed by circuitry 202 connected to the power supply 200. The pulse $\overline{ICL}$ is characterized by the generation of a slowly increasing voltage waveform upon turning switch 42 on and is used to effect automatic reset and initialization of the other microprocessor circuitry.

The command switch is connected to the input of a NAND gate 204 having an output connected to an input of AND gate 206. The output of AND gate 206 is connected to a negative pulse shaping circuit 208 and to the $\overline{SET}$ input of a latch 210 comprising NAND gates. The output of the shaping circuit 208 is also connected to the monostable multivibrator 136 adjustable via resistor 210. The pulse produced by the miltivibrator 136 is connected to a driving circuit 212 for a relay 214 controlling the presser foot solenoid valve 118.

The output of the latch 210 is connected to another driving circuit 216 for a relay 218 controlling the cam gear clutch 26. The input of the shaping circuit is connected to the limit switch 29 of the cam gear 28. One $\overline{RESET}$ input of the latch 210 is connected to master reset $\overline{ICL}$, and a second to the input of the monostable multivibrator 140 adjustable via resistor 222. The output of multivibrator 140 is connected to a positive waveform pulse shaping circuit 224, having an output connected to a $\overline{SET}$ input of latch 226. The latch 226 is connected to a driving circuit 228 for control of the feeder mechanism solenoid valve 82 through triac 230.

The microswitch 120 is connected to a negative pulse shaping circuit 232 which has an output connected to the $\overline{RESET}$ inputs of latch 226 and latch 234. Another $\overline{RESET}$ input of latch 234 is connected to master reset $\overline{ICL}$, a $\overline{SET}$ input to shaping circuit 208, and the inverted output of the latch 234 to an input of NAND gate 204 and NAND gate 236. This latter gate has another input connected to switch 44 and its output connected to the latch 226.

The output of shaping circuit 224 is also connected to a monostable miltivibrator 142 adjustable via resistor 238. The output of the multivibrator is connected to a negative pulse shaping circuit 240, having an output connected to the $\overline{RESET}$ input of a latch 242 and an inverted output connected to a NAND gate 244. The switch 46 is connected to the $\overline{SET}$ input of latch 242, the output of the latch is connected to the other input of NAND gate 244, having its output connected to the input of AND gate 206.

The operation of the circuit of FIG. 12 will now be described to illustrate the sequence of operations occuring during attachment of a tag. As discussed above, the first step is operating switch 44 which causes latch 226 to be set and the feeder arm solenoid valve 82 to be operated via driving circuit 228 and triac 230. The feeder mechanism advances a selected tag towards the attaching station until it is in place and microswitch 120 is engaged, resulting in resetting latch 226 and turning off solenoid valve 82 thereby causing the feeder mechanisn to return. A tag is now properly in place in the attaching station.

The next step is to operate command switch 48 which simultaneously turns on the presser foot solenoid valve 118 via shaping circuit 208, multivibrator 136, driving circuit 212 and relay 214, and turning on the cam gear clutch 29 via latch 210, driving circuit 216 and relay 218. Thus, the presser foot engages the garment and the attaching mechanism begins operation. Meanwhile, latch 234 has been set, thereby temporarily blocking via gate 204 any further operation from pressing command switch 48.

The duration of operation of the presser foot solenoid valve 118 is controlled by multivibrator 136. As discussed above, this has a direct effect upon the length of thread loop attaching the selected tag to the garment. When the multivibrator 136 times out, the presser foot is released.

Since the cam gear solenoid 26 is still being operated, the attaching mechanism completes its cycle of operation thereby attaching the tag. When the cycle is completed and limit switch 29 is momentarily engaged, the feeder mechanism solenoid valve 82 is again operated via the chain comprising the shaping circuit 220, multivibrator 140, shaping circuit 224, driving circuit 228 and relay 230. The feeder mechanism operates until a tag is deposited in the attaching station, microswitch 120 is engaged and the feeder mechanism is returned as described hereinabove. The latch 234 is also reset by engagement of the microswitch 120 so the system is prepared for another attaching cycle.

In the above-described sequence, the multivibrator 140 is adjusted to delay the interval between completion of the attaching mechanism and a new operation of the feeder mechanism.

If manual operation has been selected, the above sequence constitutes a finished cycle since gate 206 is blocked until another pulse is received from the command switch. If automatic operation is selected by engaging switch 46 and setting latch 242, however, the pulse causing operation of the feeder mechanism as a result of triggering of the limit switch 29 also causes multivibrator 142 to produce a pulse which is used to repeat the entire attaching cycle via shaping circuit 240, gates 244 and 206. The multivibrator 142 is adjustable to control the interval between successive attaching cycles.

Thus, successive operations of the command switch 48 are not needed to initiate an attaching cycle when the automatic mode has been selected. Disengaging switch 46 causes gate 206 to be blocked again, thereby switching to manual operation and halting the operation sequence at the conclusion of the last attaching cycle.

It may be appreciated from the foregoing that many other circuit designs can be incorporated in the microprocessor to produce the desired functions and the disclosed embodiment is intended to be illustrative of just one possible design. For example, the circuitry can be replaced or altered to include transistors or operational amplifiers. Alternately, the microprocessor may be incorporated in a single integrated circuit of an appropriate design to produce the desired operation.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A method of attaching tags to articles using thread supplied from a spool, comprising the steps of:

feeding a first tag from a tag supply to a tag attaching station;

placing the article at said attaching station under the positioned tag;

advancing a needle carrying the thread down through the positioned tag and the article;

moving a presser foot against the article to hold the same against a bottom stop;

picking up the thread end from said needle at the bottom of its travel and carrying said thread end up above the positioned tag;

releasing said presser foot at a preselected time during the upward movement of the thread end, and tying the thread end to the thread above the positioned tag;

the time interval between the pressing movement of said presser foot and the preselected release time being determinative of the size of the thread loop formed during the tag attaching operation.

* * * * *